US009224529B2

(12) United States Patent
Gery

(10) Patent No.: US 9,224,529 B2
(45) Date of Patent: Dec. 29, 2015

(54) MULTI-POLE MAGNETIZATION OF A MAGNET

(71) Applicant: Apple Inc., Cupertino, CA (US)

(72) Inventor: Jean-Marc Gery, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 16 days.

(21) Appl. No.: 14/148,563

(22) Filed: Jan. 6, 2014

(65) Prior Publication Data

US 2015/0091680 A1 Apr. 2, 2015

Related U.S. Application Data

(60) Provisional application No. 61/884,704, filed on Sep. 30, 2013.

(51) Int. Cl.
*H01F 13/00* (2006.01)

(52) U.S. Cl.
CPC ..... *H01F 13/003* (2013.01)

(58) Field of Classification Search
CPC ..... H01F 13/00; H01F 13/003
USPC ..... 335/284, 301
See application file for complete search history.

(56) References Cited

U.S. PATENT DOCUMENTS

| | | | | |
|---|---|---|---|---|
| 2,980,850 | A * | 4/1961 | Cochran | 324/242 |
| 6,441,711 | B2 | 8/2002 | Young | |
| 7,657,991 | B2 * | 2/2010 | Nakamura | 29/596 |
| 2011/0121084 | A1 * | 5/2011 | Laknin et al. | 235/492 |
| 2011/0291780 | A1 | 12/2011 | Takahashi et al. | |
| 2012/0038440 | A1 * | 2/2012 | Roberts et al. | 335/284 |

FOREIGN PATENT DOCUMENTS

| | | |
|---|---|---|
| CN | 2038658 | 5/1989 |
| JP | 01169908 | 7/1989 |
| JP | 2006351627 | 12/2006 |

OTHER PUBLICATIONS

International Application No. PCT/US2014/057853—International Search Report and Written Opinion dated Dec. 24, 2014.

* cited by examiner

*Primary Examiner* — Mohamad Musleh
(74) *Attorney, Agent, or Firm* — Downey Brand LLP

(57) ABSTRACT

A method of magnetizing a multi-pole magnet includes the steps of obtaining a magnetization coil having a magnetization zone and a central axis, and positioning a magnet within the magnetization zone. The method also includes positioning at least one pair of shield bodies including a conductive material proximate the first and second surfaces of the magnet, with the shield bodies being aligned together to cover both sides of at least a first region of magnet and expose both sides of at least a second region of the magnet. The method further includes energizing the magnetization coil to generate an applied magnetic field within the magnetization zone that is sufficient to induce eddy currents in the at least one pair of shield bodies and to magnetize the exposed second region of the magnet.

19 Claims, 9 Drawing Sheets

MULTI-POLE MAGNETIZATION OF A MAGNET

CROSS REFERENCE TO RELATED APPLICATIONS

This application claims the benefit of U.S. Provisional Patent Application No. 61/884,704, filed Sep. 30, 2013, and entitled "MULTI-POLE MAGNETIZATION OF A MAGNET", the disclosure of which is hereby incorporated by reference in its entirety for all purposes.

BACKGROUND

1. Technical Field

The described embodiments relate generally to the magnetization of permanent magnets, and more specifically to methods and systems for magnetizing a permanent multi-pole magnet made from a body of magnetic material.

2. Related Art

Permanent multi-pole magnets made from rare earth materials have found application in the industrial arts, especially for uses relating to the enclosures and casings for personal computerized products such as laptops, tablets and smart phones. However, the smaller, more compact designs are often expensive to manufacture, since in many cases the multi-pole magnets are assemblies of the individual magnetic pieces that are initially formed as bar stock and magnetized to a predetermined polarity and magnetic strength, and then cut into the desired size and shape for assembly into a magnetic array.

The high expense for these multi-pole magnetic arrays is generally the result of the initial cost of the preferred rare earth magnetic materials, such as neodymium, that must be obtained from overseas suppliers, as well as the cost of the precision fabrication processes that are used to cut and shape the discrete, individual magnetic pieces into their final form before assembly in a magnetic array. In some instances, a significant amount of magnetic material can be lost during the various manufacturing steps, especially when the completed magnetic array is formed from individual magnetic pieces having curved shapes.

Consequently, a need exists for improved systems and methods for reliably producing multi-pole permanent magnets that simultaneously reduce fabrication costs while minimizing the amount of magnetic material that is wasted or lost during production. It is towards such a magnetizing system that the present disclosure is directed.

SUMMARY

Briefly described, one embodiment of the present disclosure includes a method for magnetizing a permanent multi-pole magnet. The method includes the steps of obtaining a magnetization coil having a magnetization zone and a central axis, and positioning a magnet within the magnetization zone. The magnet can be a single, monolithic body or an assembled magnetic array of discrete magnetic pieces. Moreover, the magnet may be pre-magnetized or provided in an un-magnetized state. The method also includes positioning one or more pairs of shield bodies, each comprising a conductive material, proximate first and second surfaces of the magnet, with the shield bodies being aligned together to cover both sides of a first region of magnet and expose both sides of a second region of the magnet. The method further includes energizing the magnetization coil to generate an applied magnetic field within the magnetization zone that is sufficient to induce eddy currents in the shield bodies and to magnetize the exposed second region of the magnet.

Another embodiment of the present disclosure includes a system for magnetizing a permanent multi-pole magnet. The magnetization system includes a magnetization coil having a magnetization zone and a central axis that is configured to generate a magnetic field within the magnetization zone having flux lines that are substantially parallel to the central axis. The magnetization zone is sized and shaped to receive a magnet that is oriented transverse to the central axis. The system also includes one or more shield bodies that are comprised of a conductive material having a thickness sufficient to allow for the inducement of eddy currents within the shield bodies. The shield bodies are further adapted for positioning proximate one or more surfaces of the magnet so as to cover a first portion of the surfaces and expose a second portion of the surfaces. In addition, energizing the coil generates a magnetic field within the magnetization zone having a field strength that is sufficient to magnetize one or more regions of the magnet proximate the exposed surfaces and to induce eddy currents in the shield bodies that are configured to shield one or more regions of the magnet proximate the covered surfaces.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings in which.

Figure 1A:
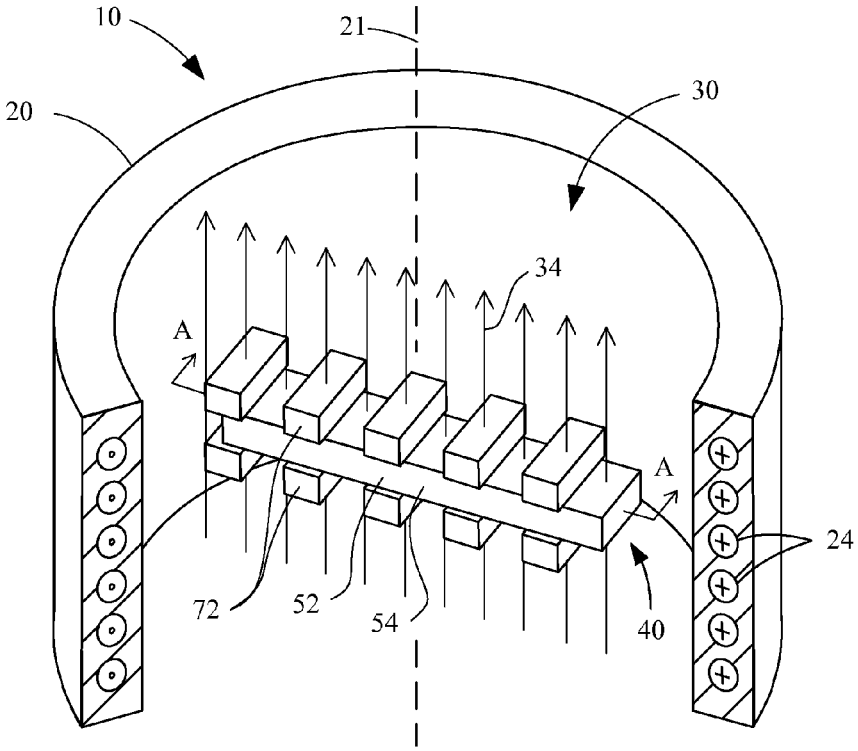
FIGS. 1A-1C are perspective, cut-away views of a permanent magnet disposed within the magnetizing zone of a magnetization system, in accordance with one representative embodiment of the present disclosure.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The described embodiments relate to a system and method for, in one embodiment, magnetizing a monolithic member with different polarities using an external magnetic field. In another embodiment, discrete magnetic elements can be assembled into a magnetic assembly where selected ones of the discrete magnetic elements can be magnetized in an appropriate manner. In one embodiment, the magnetic assembly can be inserted into another structure (such as a housing) whereupon the selected ones of the discrete magnetic elements can be magnetized. In one embodiment, a conductive masking element can be used during a magnetization process. The conductive masking element can utilize eddy currents induced by the external magnetic field that create an induced magnetic field of opposite polarity. In one example, the entire monolithic member can be magnetized with a first polarity (such as N(orth)) and thereafter is masked in areas where the first polarity is desired. Thereafter, the masked monolithic member can undergo one or more magnetization steps in order to magnetize select portions (unmasked) with an additional polarity or polarities. When sufficient energy is provided, magnetic domains can change polarities. In this way, the unmasked areas can change from the first polarity to the second polarity while the masked areas maintain the first polarity. As a result, different patterns can be created, for example, any combination of N, S orientations, and any combination of lengths can be achieved. For example, a 2N, S, N or N, 2S, N and/or the like can be created in a single monolithic member. In one embodiment, the magnetization steps are carried out in the same machine. In another embodiment, the monolithic member may remain in the magnetizer that provides a magnetizer magnetic field during both steps (e.g., chucked in the machine). Although opposite polarity field lines can be created, in some instances, lines that are perpendicular to one another can be created. In one embodiment, a Halbach array can be created in a single monolithic member using the above mentioned technique.

More specifically, the ability of the masking element to provide a magnetic shield can be based upon Lenz's Law. Lenz's law states that the current induced in a conductor due to a change in the magnetic field is so directed as to oppose the change in flux. In other words, any changes in a magnetic field provided by a magnetizer induce an electric current (also referred to as an eddy current) in a magnetic shield formed of an electrical conductor such as copper or silver that interacts with the magnetic field. The eddy currents in turn create a magnetic field of opposite polarity to that of the magnetizer magnetic field. The opposing polarity magnetic field provides the requisite shielding effect to the monolithic member by reducing the magnetizer magnetic field to a field strength less than a threshold value required to change a magnetic domain from one polarity to an opposite polarity.

Illustrated in FIGS. 1-10 are several representative embodiments of a system and methods for magnetizing a permanent multi-pole magnet, and in particular for magnetizing a permanent multi-pole magnet made from a single, monolithic body of magnetic material. As described in more detail below, the system and methods of the present disclosure provide several significant advantages and benefits over other methods for magnetizing material to form magnets. The recited advantages are not meant to be limiting in any way, however, as one skilled in the art will appreciate other advantages may also be realized upon practicing the present disclosure. In addition, it is also to be appreciated that the various aspects, embodiments, implementations or features of the described embodiments can be used separately or in any combination, and that other uses and applications are also possible and may be considered to fall within the scope of the present disclosure.

As used herein, the term "permanent magnet" refers to a magnet that is magnetized and maintains its own persistent magnetic field after removal from a magnetizer. The strength and polarity of the magnet's persistent magnetic field is changeable; however, a change in polarity involves exposure of the magnet to an external magnetic field having sufficient strength to re-align the magnetic domains in the magnetic material. In other words, an amount of energy must be provided by a magnetizing magnetic field to change a magnetic domain from a first polarity to a second polarity (such as N to S or vice versa).

Figure 1B:
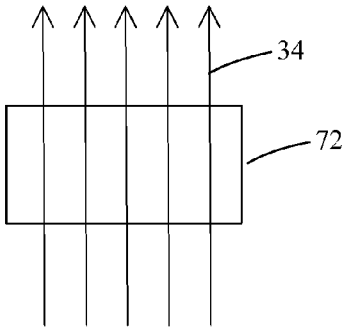
Figure 1C:
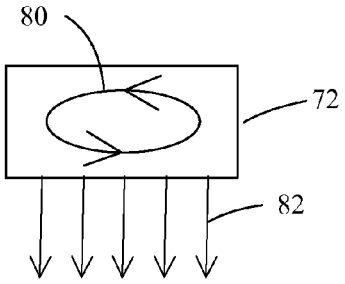

Referring now in more detail to the drawing figures, wherein like parts are identified with like reference numerals throughout the several views, FIG. 1A is a perspective, cutaway view of a magnetization system 10 for magnetizing a permanent multi-pole magnet 40, in accordance with one embodiment of the present disclosure. The magnetization system 10 generally includes a magnetization coil 20 made of windings 24 formed of conductive material. Magnetization coil 20 is depicted as being centered about a central axis 21. The internal volume defined by the magnetization coil 20 can be considered a magnetization zone 30. The magnetization coil 20 further includes a power or current source (not shown, but known to one of skill in the art) that is configured to direct an electric current through the windings 24 in the magnetization coil 20 so as to generate an applied magnetic field 32 within the magnetization zone 30. As shown in FIG. 1B, when current is directed through windings 24 of the magnetization coil 20 in a first direction, a polarity of the applied magnetic field 32 is positive with flux lines 34 directed upwards and substantially parallel to the central axis 21 of the magnetization coil 20.

A magnet 40 made from a magnetic material, including but not limited to rare earth metal alloys such as Neodymium Iron Boron (NdFeB) or Samarium Cobalt (SmCo), is positioned within the magnetizing zone 30 of the magnetization coil 20. The magnet 40 is generally positioned in an orientation that is transverse to the central axis 21 of the magnetization coil 20, so that the flux lines 34 of the applied magnetic field 32 are perpendicular (or thereabouts) and extend through the thickness of the magnet 40. However, in other aspects the magnet 40 may be positioned in any orientation relative to the central axis 21 of the magnetization coil 20. Even positions in which the magnet 40 is aligned with the central axis 21 so that the flux lines 34 extend through the length or through the width of the magnet body are possible.

For illustrative purposes, the magnetization coil 20 is shown in FIG. 1A as being a circular magnetization coil 20 with a central axis 21 that is oriented in a first direction. However, it will be understood that the magnetizer of the present disclosure is not limited to this configuration, and that in other aspects the coil may be non-circular or be provided in any size and shape that is suitable for receiving the permanent magnet within a magnetization zone. In addition, the central axis of the coil may be oriented in any direction.

Prior to energizing the magnetization coil 20 to generate the applied magnetic field 32, the initial state of the magnetic material 44 can be an un-magnetized state. In other aspects, the magnetic material forming the magnet 40 can be previously magnetized with one or more magnetized zones having any particular polarity or direction.

The applied magnetic field 32 generated by the magnetization coil 20 can be strong enough to saturate the magnetic material 44 of the magnet 40 by aligning or re-aligning substantially all of the magnetic domains within the exposed magnetic material 44 with the same polarity as the applied magnetic field 32, thereby creating a magnet 40 with a desired magnetic state or polarity. Thus, the magnetization coil 20 can be used either to impress a particular magnetic polarity on a previously un-magnetized magnet body, or to re-magnetize the pre-magnetized material with a magnetic polarity different from one that had been previously applied.

Also shown in FIG. 1A is a mask that includes shield bodies 72 that are positioned next to an upper surface and a lower surface of the magnet 40. The shield bodies 72 can be aligned in pairs to subdivide the magnet 40 into protected regions 52 and exposed regions 54, with both sides of the protected regions 52 of the magnet 40 being covered by shield bodies 72. The shield bodies 72 are generally formed from a highly-conductive material such as copper or silver, and are provided with a length, width and thickness that allows for the formation of eddy currents 80 within the shield bodies 72 in response to the applied magnetic field or flux lines 34 (FIG. 1B) passing through the shield bodies 72. In turn, the eddy currents 80 generate a counter magnetic flux 82 (FIG. 1C) that opposes the flux lines 34 generated by the magnetization coil 20, thereby shielding the protected regions 52 of the magnet 40 from the applied magnetic field (FIG. 1A). As a result, only the magnetic domains located within the exposed regions 54 of the magnet body 40 will be magnetized or re-magnetized with the same polarity as the applied magnetic field.

The magnetic shielding provided by shield bodies 72 can be better understood with reference to FIGS. 2A-2D, which are cross-sectional schematic views of the permanent magnet 40 and magnetization system 20 of FIG. 1A, and that together illustrate one method of magnetizing a multi-pole magnet 40. As first shown in FIG. 2A, the exemplary magnet 40 can initially comprise a monolithic magnet 40 (or discrete magnetic elements) formed as a single piece of permanent magnetic material. The magnet 40 generally includes a first upper surface 46 and a second lower surface 48. In addition, the magnet 40 may be prepared in an un-magnetized state, as depicted by the randomly oriented magnetic domains 50 of the magnet 40.

Figure 2A:
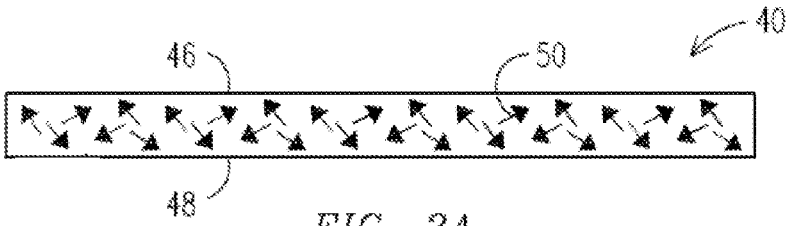
FIGS. 2A-2D are cross-sectional schematic views of the permanent magnet and magnetization system as viewed from section line A-A of FIG. 1A, and together illustrate one method of magnetizing a permanent multi-pole magnet, in accordance with another representative embodiment.
Figure 2B:
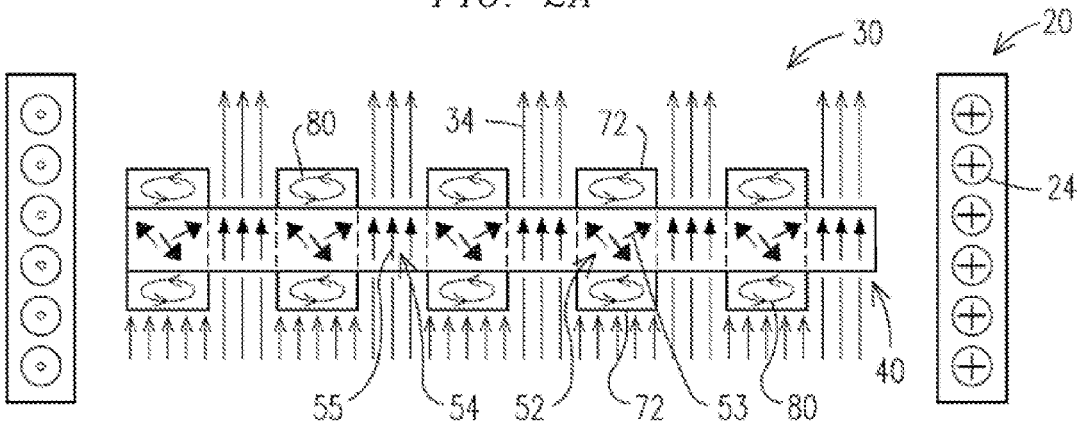

With continued reference to FIG. 2B, the magnet 40 can be placed within the magnetization zone 30 of the magnetization coil 20 and the shield bodies 72 can be applied to both the upper surface 46 and the lower surface 48, with pairs of shield bodies 72 being aligned to cover both sides of the protected regions 52 of the magnet 40. As may be appreciated, the shield bodies 72 can be placed in proximity to (or in contact with) the magnet 40 either before or after the magnet 40 is positioned within the magnetization zone 30. In some aspects, for instance, the shield bodies 72 can be coupled to the surfaces of the magnet 40 with an adhesive or similar compound prior to installing the magnet 40 into the magnetization coil 20. In other aspects, the shield bodies 72 can be coupled together into an independently supported structure that is moved into position adjacent the upper and lower surfaces of the magnet 40. In some embodiments, the independently supported structure can be configured to force the mask into contact the magnet 40. Other configurations for positioning the shield bodies adjacent the outer surfaces 46, 48 of the magnet 40 are also possible.

Figure 2C:
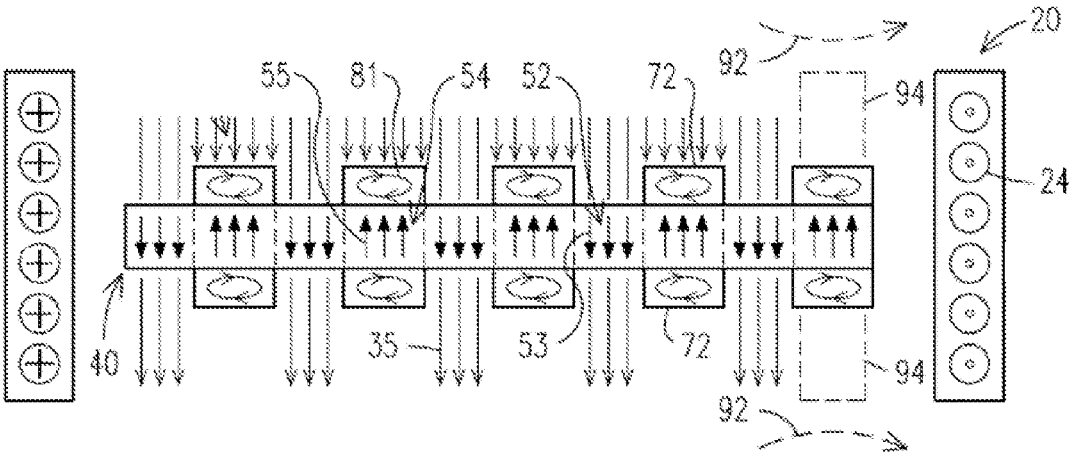

When the magnetization coil 20 is activated or energized by directing a current 26 through the windings 24 that form the coil 22, the shield bodies 72 can function as a stencil that alternately shields the protected regions 52 of the magnet 40, while exposing the unprotected regions 54 to the full effects of the flux lines 34 of the applied magnetic field 32. As described above, the shielding effects of the shield bodies 72 can be achieved through the induced formation of eddy currents 80 within the shield bodies 72 induced by the applied flux lines 34. While the eddy currents 80 shown in FIGS. 2B and 2C are represented by the circulating lines within the shield bodies 72, it is understood by one of skill in the art that according to Lenz's Law, the actual eddy currents generally circulate about an axis that is parallel with the flux lines 34 of the applied magnetic field.

As understood by one of skill in the art, the rare earth magnetic materials that form the magnet 40 generally have a high coercivity (i.e. resistance to withstand an externally applied magnetic field) before the magnetic domains in the material changes to a new alignment. In other words, the field strength of the externally applied magnetic field passing through the magnetic material must exceed an energy threshold before the magnetic domains begin to become aligned with the flux lines 34 of the applied magnetic field. The counter magnetic flux 82 (FIG. 1C) generated by the eddy currents 80 can oppose or deflect the flux lines 34 of the applied magnetic field to a degree that reduces the magnetic field below the energy threshold in the protected regions 52 of the magnet 40. As a result, only the magnetic domains located within the exposed regions 54 will be magnetized or re-magnetized with the same polarity as the applied magnetic field.

In order to induce the formation of the eddy currents 80 within the shield bodies 72, the applied magnetic field may be generated as a number of short, repetitive magnetic pulses that are sequenced together to build up and maintain the eddy currents 80 within the shield bodies 72 throughout a magnetization cycle. In one aspect, the magnetic pulses can have a duration of about 1 microsecond and can be separated by intervals of about 1 millisecond. In other aspects, the magnetic pulses and the separating intervals can be longer or shorter in duration, and can be different in duration relative to each other. Directing a matching sequence of current pulses through the windings 24 of the magnetizer coil 20 in positive, counter-clockwise direction can generate the repetitive magnetic pulses.

In addition, in order to generate the short duration, high intensity magnetic pulses within the magnetization zone 30, the magnetization coil 20 can be smaller and have a lower inductance than the coils found in existing magnetization system that magnetize permanent magnets using a single, long duration pulse of magnetic energy. In up-scaling the magnetization system of the present disclosure for mass production, moreover, it may be beneficial to utilize a large number of smaller, reduced-induction coils than a small number of large, high-induction coils in processing an equivalent number of permanent magnets.

The sequence of repetitive magnetic pulses that make up the applied magnetic field will generally be applied in the same direction (i.e. having the same polarity), with the cumulative effects of the magnetic pulses reaching sufficient strength or magnitude so that the magnetic material in the exposed regions 54 can become magnetically saturated (i.e. when an increase in the applied magnetic field cannot further increase the magnetization of the material) over the length of the magnetization cycle. In other words, substantially all of the magnetic domains 55 within the exposed regions 54 of magnetic material can be aligned with the same polarity as the applied magnetic field 32.

In addition, in some aspects the strength of the applied magnetic field 32 may be controlled over the length of the magnetization cycle to a value that is less than the magnitude needed to saturate the magnetic material 44 in the exposed regions 54. This technique can be used to control the final degree of magnetization of the exposed regions 54, and can provide for the production of permanent multi-pole magnets 40 in which the magnetic output varies along the length or width of the magnet body in accordance with a desired user experience.

Depending on the initial state of the magnet 40 and the desired magnetization of the final product, the multi-pole magnet may be complete after a single magnetization treatment. In another aspect of the disclosure shown in FIG. 2C, upon completion of the magnetization of the exposed regions 54 of the magnet 40, the shield bodies 72 can be moved relative to the magnet 40 so that the shield bodies 72 now cover the regions 54 that have been magnetized in the first or positive direction, while leaving exposed the previously protected regions 52. With the mask in the second position, the magnetization coil 20 can then be energized with an applied magnetic field 33 being oriented in a second direction opposite the applied magnetic field. This may be achieved by directing a sequence of current pulses through the windings 24 that form the magnetization coil 20 in a negative, clockwise direction.

As with the previous magnetization step, the shielding bodies 72 can function as a stencil that alternately shields the previously magnetized portions 54 of the magnet 40 while exposing the previously protected regions 52 of the magnet 40 to the full effects of flux lines 35 of the applied magnetic field 33. The cumulative effects of the magnetic pulses can again reach a sufficient magnitude so that the magnetic material 44 in the newly-exposed regions 52 becomes magnetically saturated over the duration of the magnetization cycle, with substantially all of the magnetic domains 53 within the exposed regions 52 becoming aligned with the flux lines 35 of the applied magnetic field shown in FIG. 2C. Here again, the shielding effects of the mask 70 can be achieved through the induced formation of oppositely directed eddy currents 81 within the shield bodies 72 by the pulsating magnetic field.

Figure 2D:
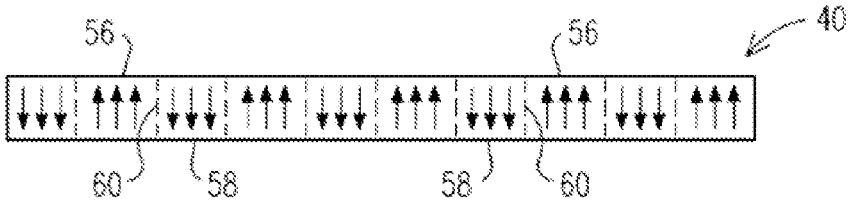

The resulting monolithic, multi-pole magnet 40 with alternating positively directed (i.e. north) magnetized regions 56 and negatively directed (i.e. south) magnetized regions 58 is illustrated in FIG. 2D. As will be discussed in more detail below, the oppositely magnetized regions or poles 56, 58 can be separated by narrow transition regions 60 that minimize any dead zones between the poles.

As may be appreciated by one of skill in the art, the inducement of the protective eddy currents within the shield bodies can generate substantial amounts of heat. Depending on a duration and intensity of the magnetization steps, a heat removal apparatus can be necessary to remove heat from the area surrounding the shield bodies 72. This may be accomplished with an apparatus utilizing active or passive means, such as forced air ventilation 92 across the outer surfaces of the mask, or through the coupling of a heat sink 94 directly to the backside surfaces of the shield bodies 72, as further illustrated in FIG. 2C.

Figure 3:
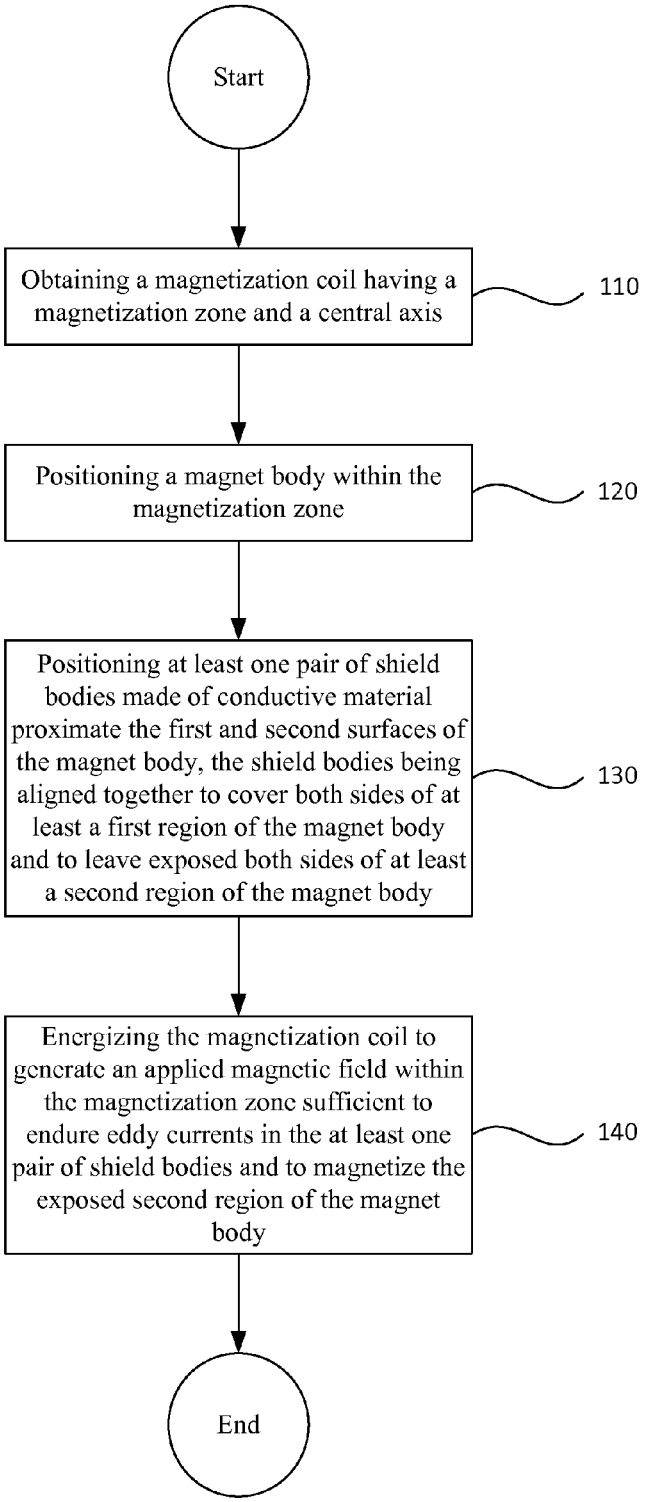
FIG. 3 is a flowchart depicting a method of magnetizing a permanent multi-pole magnet, in accordance with yet another representative embodiment.

FIG. 3 is a flowchart depicting a method 100 of magnetizing a multi-pole magnet that is similar to the method illustrated in FIGS. 2A-2D. The method 100 includes the steps of obtaining 110 a magnetization coil having a magnetization zone and a central axis, and positioning 112 a magnet body within the magnetization zone. The method 100 also includes positioning 114 at least one pair of shield bodies comprising a conductive material proximate first and second surfaces of the magnet body, with the shield bodies being aligned together to cover both sides of at least a first region of magnet body and expose both sides of at least a second region of the magnet body. The method 100 further includes step 116 in which the magnetization coil is energized to generate an applied magnetic field within the magnetization zone that is sufficient to induce eddy currents in the at least one pair of shield bodies and to magnetize the exposed second region of the magnet body.

The system and methods of FIGS. 1-3 can be used to magnetize a wide variety of magnetic bodies with different arrangements for the oppositely directed poles. Similar to the multi-pole magnet shown in FIG. 2D, for example, the elongated magnet 210 of FIG. 4A can include an arrangement of positively directed (i.e. north) magnetized regions 214 and negatively-directed (i.e. south) magnetized regions 216 that are equally distributed along the length of the elongated magnet 210 and separated by sharply-defined transition regions 218. In another aspect shown in FIG. 4B, the elongate magnet 220 may be magnetized with magnetized regions 224, 226 having unequal and customized lengths.

Figure 4A:
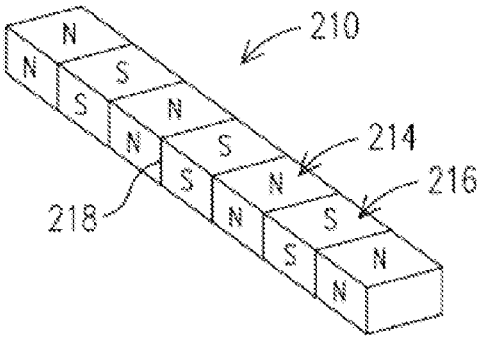
FIGS. 4A-4E illustrate various exemplary embodiments of permanent multi-pole magnets that may be magnetized using the magnetization system and methods of FIGS. 1A-3.
Figure 4B:
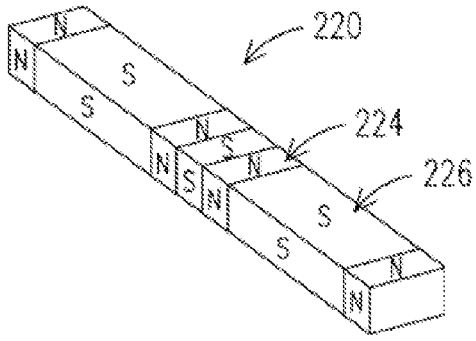
Figure 4C:
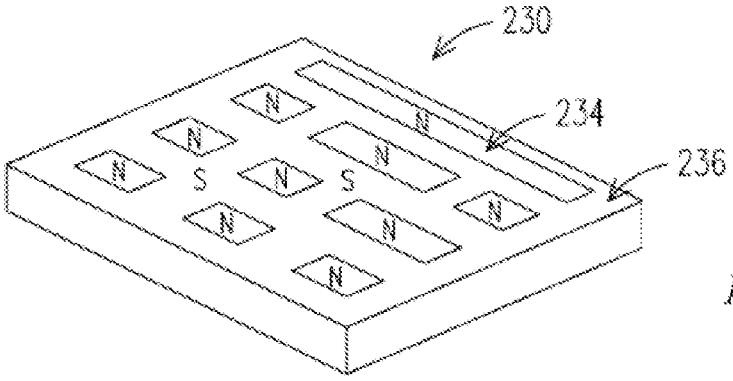
Figure 4D:
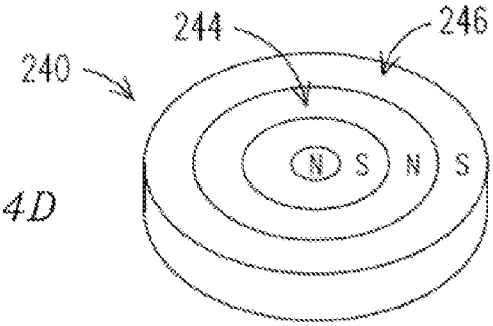

As shown in FIG. 4C, a magnet 230 may also include a number of positive magnetic regions 234 that are distributed across the expanse of a rectangular magnet body 232 that has been magnetized to a negative magnetic state 236. In this illustrative embodiment, the entire magnet body 232 may first be magnetized to either a positive or negative state, and then a mask, either comprising a plurality of shield bodies with shapes corresponding to the positive regions 234 or a block with shaped cut-outs that covers the negative region 236, can be positioned proximate the upper and lower surfaces of the magnet body 232. The exposed regions of the magnet 230 can then be re-magnetized to the opposite polarity to form the magnet 230 having a customized configuration of oppositely directed magnetic regions 234, 236. A similar process may be used to form the magnet 240 of FIG. 4D with alternating positively- and negatively-magnetized rings 244, 246.

Figure 4E:
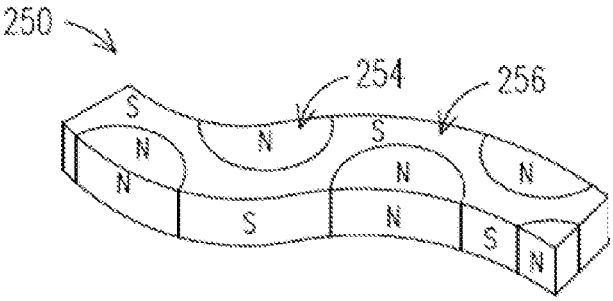

One advantage of the disclosed method and system for magnetizing a multi-pole magnet is the ability to magnetize a curved monolithic body 252 of permanent magnetic material into a permanent magnet 250 having sharply-defined oppositely-directed magnetic regions or poles 254, 256, as illustrated in the exemplary embodiment of FIG. 4E. Thus, in addition to the variety of shaped magnetized regions 254, 256 that can be produced with a mask having custom-shaped shield bodies, the monolithic body 252 of the magnet 250 can also be formed with a customized, non-rectilinear shape prior to the magnetization steps that form the magnetic regions. This can result in a curved multi-pole magnet 250 that can be economically produced for inclusion within other curved structures and to perform a variety of applications.

In one aspect, the magnet body, the shield bodies of the mask, and the applied magnetic field can be optimized to produce magnetized regions or magnetized features in the magnet body having a radius of curvature great than or about 1 millimeter.

Figure 5A:
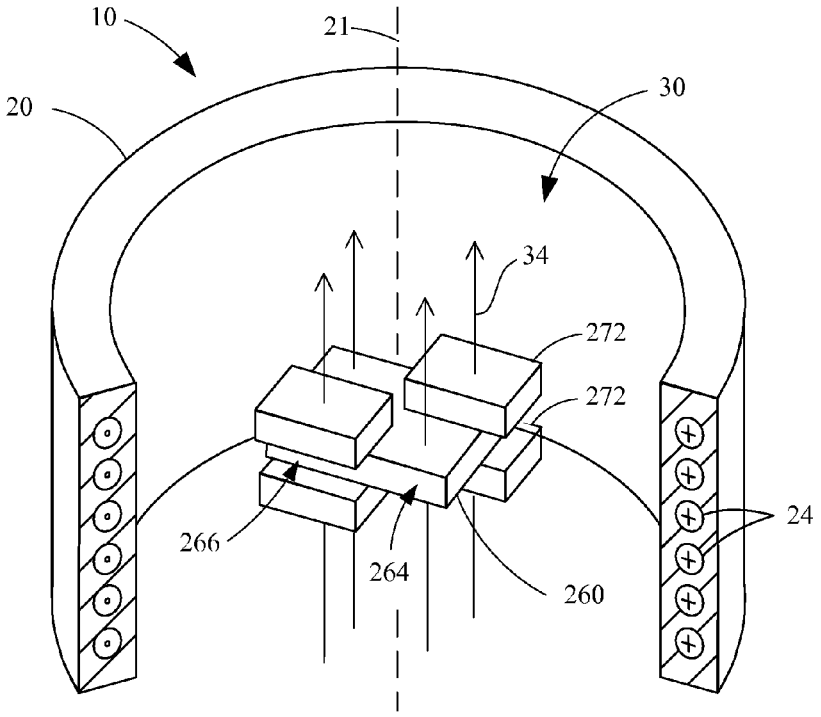
FIGS. 5A-5B are perspective, cut-away views of a permanent magnet disposed within a magnetizing zone of a magnetization system and a schematic view of the permanent magnet after magnetization, respectively, and in accordance with another representative embodiment of the present disclosure.

FIG. 5A is a perspective, cut-away view of permanent magnet 260 disposed within magnetizing zone 30 of magnetization coil 20. In this embodiment, permanent magnet 260 can have a more-rectangular aspect ratio with a center aperture formed through the thickness of the permanent magnet 260, and the mask can include two pairs of shield bodies 272 that cover opposite corners. Energizing the magnetization coil 20 can generate the applied magnetic field that magnetizes the exposed regions 264 of the permanent magnet 260 in the positive direction, while eddy currents induced within shield bodies 272 function to shield the protected regions 266. It is further understood that the protected regions 266 may be pre-magnetized or may be magnetized in the opposite direction in a subsequent magnetization step in which the arrangement of the shield bodies 272 has been reversed.

Figure 5B:
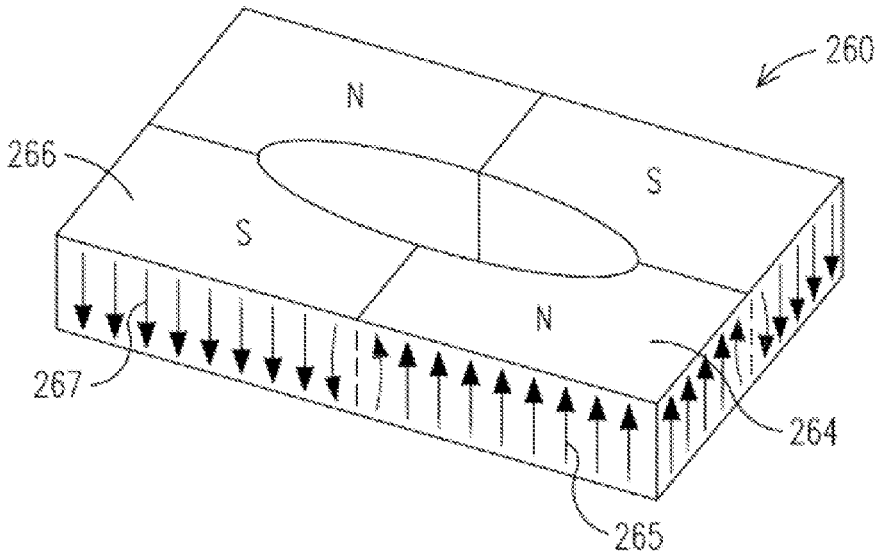

FIG. 5B is a schematic view of the permanent magnet 260 after magnetization, and illustrates the magnetic domains 265 of the positively directed (i.e. north) magnetized regions 264 and the magnetic domains 267 of the negatively directed (i.e. south) magnetized regions 266. As may be appreciated, the multi-pole permanent magnet 260 can be formed as a single, monolithic body of magnetic material in which the various poles are subsequently magnetized to substantially the same degree of magnetization, rather than from four separate pieces of magnetic material that are individually formed, magnetized, and then assembled into a magnetic array have the same configuration. Consequently, the monolithic version of the permanent magnet 260 can be substantially less expensive to manufacture while providing a more uniform, consistent, and controllable magnetization across the expanse of the permanent magnet 260.

Figure 6A:
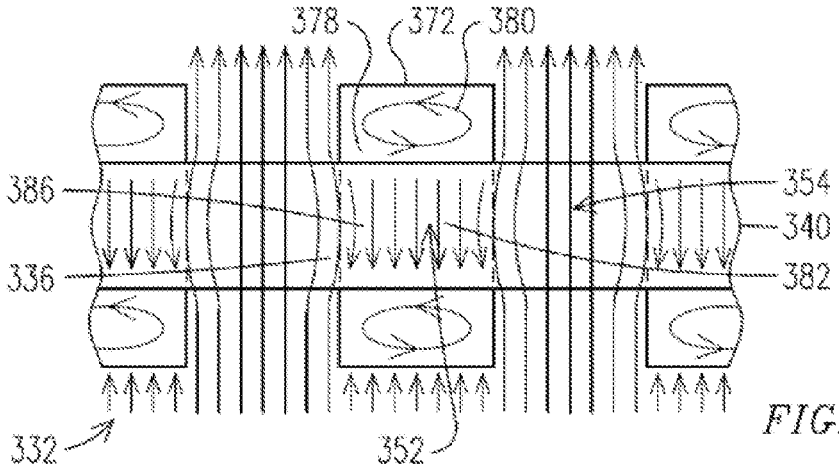
FIGS. 6A-6B are close-up schematic views of a mask of the magnetization system and the permanent magnet, in accordance with another representative embodiment.
Figure 6B:
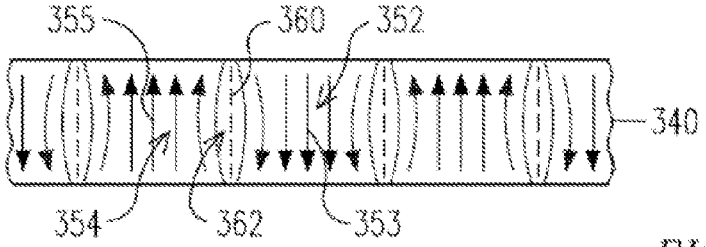

In accordance with another representative embodiment, a close-up schematic view the interaction between portions of the applied magnetic field 332 and the shield bodies 372 during magnetization of a permanent magnet 340 is provided in FIG. 6A, along with the resulting alignment of the magnetic domains within the permanent magnet 340 after magnetization. As can be seen in FIG. 6A, in cases where the interior edges of the shield bodies 372 are formed with straight corners 378, the flux lines 336 of the magnetic field 332 that are closest to the shield bodies 372 may spread or "fringe" from the exposed region 354 into the protected region 352 of the magnet body 342 and cause an inward bowing of the outermost 386 of the counter flux lines 382 that are generated by the eddy currents 380. Once magnetization is complete, as shown in FIG. 6B, the resulting magnetic domains 353 of the protected region 252 and the magnetic domains 355 of the exposed region 354 may bow away from each other proximate the transition region 360 between the two poles, creating a dead zone 362 of weakly-aligned or non-aligned magnetic domains in and around the transition region 360. If the dead zones 362 in each of the transition regions 360 are large, the decrease in the volume of magnetized material may reduce the magnetic output of the magnet 340.

Figure 7A:
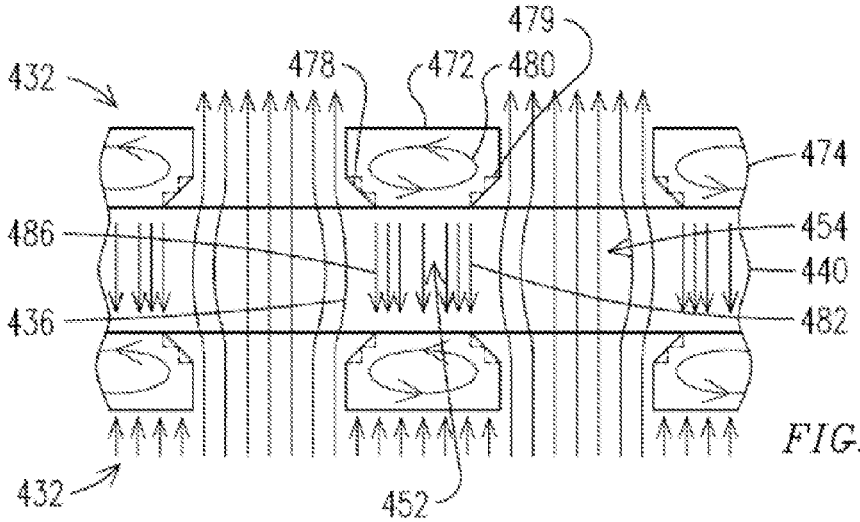
FIGS. 7A-7B are close-up schematic views of the mask of the magnetization system and the permanent magnet, in accordance with yet another representative embodiment.
Figure 7B:
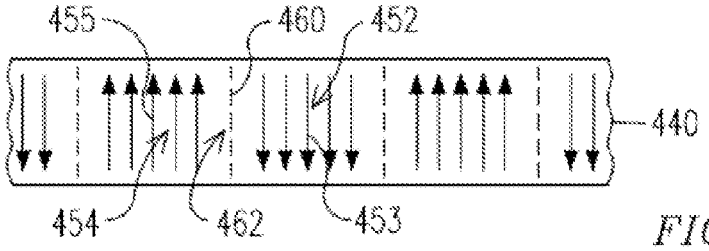

Accordingly, in one aspect of the present disclosure illustrated in FIG. 7A, the shield bodies 472 of the mask can be formed with a beveled interior edge 478, with a stepped interior edge 479, or with a similar edge profile treatment. The edge profile treatment can function to channel or focus the counter flux 482 that is generated by the eddy currents 480 into the smaller surface area adjacent the upper and lower surfaces of the magnet 440, and can be especially effective at the reinforcing and concentrating the outermost 486 of the counter flux lines 482 in the protected region 452 so as to reduce the inward incursion or fringing of the flux lines 436 of the applied magnetic field 432 in the exposed region 454. As can be seen in the resulting magnet 440 of FIG. 7B, the magnetic domains 453 of the protected region 452 and the magnetic domains 455 of the exposed region 454 proximate the transition region 460 are both denser and closer to vertical, resulting in a substantial reduction in the size of the dead zones 462 and a corresponding increase in the effectiveness and magnetic output of the magnet 440.

As illustrated in the various drawings, the sides of the shield bodies may be configured to extend beyond the edges of the protected region (FIG. 7A) or beyond the side edges of the magnet body (FIGS. 1, 5A), thereby increasing the effective 'footprint' of the shield body within the applied magnetic field. This may be done to increase the strength of the eddy currents circulating within the shield body, to reduce or eliminate any undesirable magnetization along the side surfaces of the magnet body, and/or to provided spacing for the edge treatments described above. The shape of the shield bodies can also be optimized to control the shape of the dead zone by directing the counter flux deeper or at different angles into the magnet body.

Figure 8A:
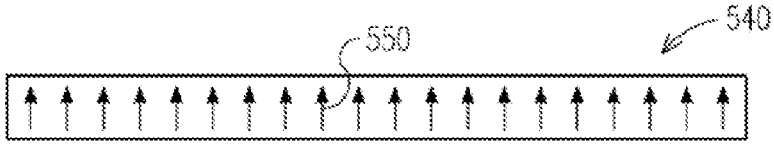
FIGS. 8A-8C are cross-sectional schematic views of a permanent magnet and the magnetization system, in accordance with yet another representative embodiment.
Figure 8B:
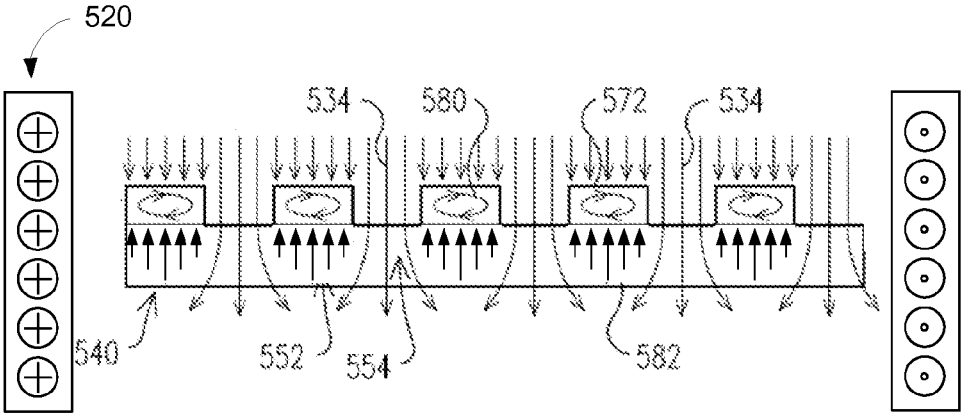
Figure 8C:
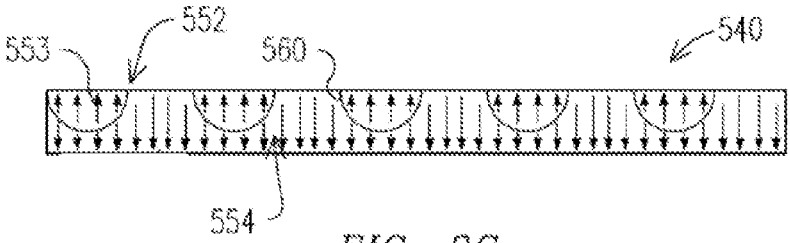

In another aspect of the disclosure illustrated in FIGS. 8A-8C, the permanent magnetic material of a magnet 540 can be uniformly pre-magnetized so that all of the magnetic domains 550 are generally aligned in a first direction. For illustrative purposes the first direction can be positive, as depicted in FIG. 8A. The magnet 540 can then be placed within a magnetization coil 520 and surrounded by a number of shield bodies 572 disposed on just one side of the magnet 540, as shown in FIG. 8B, and the magnetization coil 520 can be activated to generate an applied magnetic field with flux lines 534 oriented in the opposite, or negative direction. As discussed above, the applied magnetic field 532 will induce the eddy currents 580 within the shield bodies 572 that in turn create the counter flux 582 that cancels or deflects the flux lines 534 in the protected regions 552 of the magnet. However, with shield bodies 572 being applied to only one side of the magnet 540, the protective counter flux 582 may not extend all the way through the thickness of the magnet 540.

Consequently, the protected regions 552 of magnetic material may only be found directly underneath the shield bodies 572, and the magnetic domains of the remaining region 554 of exposed material will be magnetized to the direction of the applied magnetic field 532. As shown in the FIG. 8C, this may leave only a few protected regions (also referred to as dimples) 552 with magnetic domains 553 that maintain their original magnetic state. In one aspect, the protected regions 552 can have a transition region 560 that extends only partially through the thickness of the magnet, thereby forming a three-dimensional magnetic structure within the magnet body 542.

As described above, the method and system of the present disclosure can be used to magnetize a multi-pole magnet made from a single, monolithic body of permanent magnetic material. However, the method and system are not limited to monolithic bodies, and in other aspects may be used to magnetize magnets formed from a plurality of discrete pieces of magnetic material that have been individually shaped or cut, and then assembled or coupled together to form an assembled magnetic array or magnet body. The discrete individual pieces may or may not be magnetized with independent magnetic orientations prior to assembly into the magnetic array. After assembly, the magnetic array can then be installed within the magnetization system of the present disclosure for additional modification or adjustment of the magnetic properties of one or more of the individual pieces, or if desired, of the entire magnetic array as a whole.

For example, through the use of a mask having one or more shield bodies configured to protect the non-affected pieces, the magnetization system described herein can be used to affect the magnetization strength and/or polarity of any individual piece in the magnetic array. Thus, each of the discrete pieces may be individually adjusted or balanced to have the same strength. Alternatively, a desired variation in field strength along the length or width of the magnetic array can be applied to create a customized magnetic profile that meets a desired user experience.

Figure 9A:
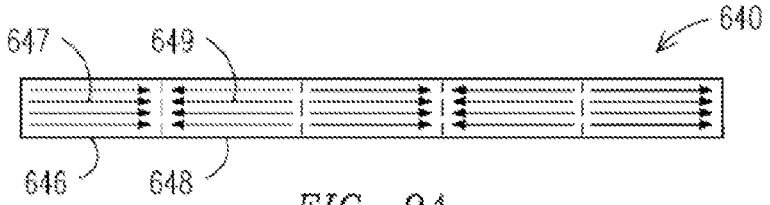
FIGS. 9A-9D are cross-sectional schematic views of a permanent magnet and the magnetization system, in accordance with yet another representative embodiment.
Figure 9B:
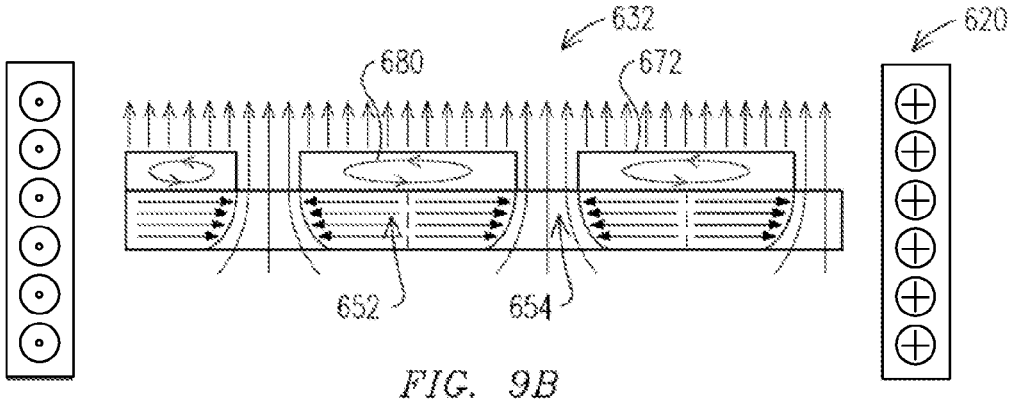
Figure 9C:
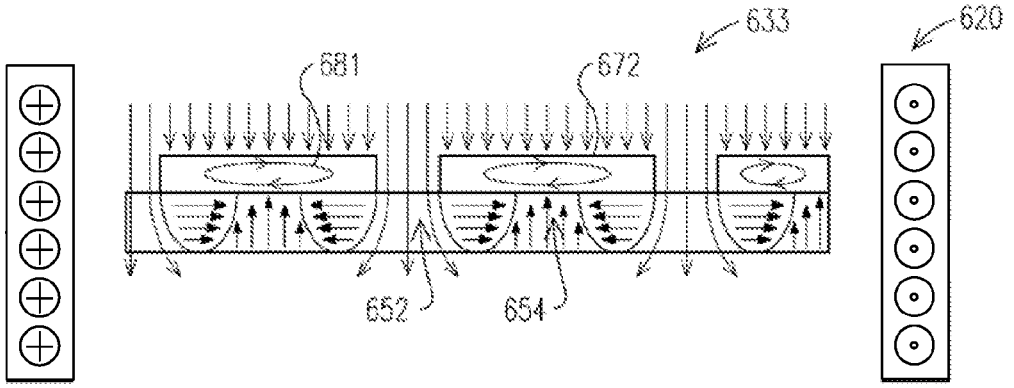

FIGS. 9A-9D illustrate a representative process for magnetizing a magnet 640 made from a magnetic array formed from discrete pieces 646, 648 of pre-magnetized magnetic material. Subsequent to formation of the magnet 640, the magnet 640 can be magnetized using the three-dimensional magnetizing process described above. For instance, after their initial magnetization, each of the individual pieces 646, 648 can be coupled end-to-end so that their magnetic domains 647, 649 are alternately directed toward and away from each other, as shown in FIG. 9A. The magnet 640 can then be installed within the magnetization coil 620 and a mask including a number of shield bodies 672 can be positioned proximate one side of the array. As illustrated in FIG. 9B, the shield bodies 672 can cover every-other boundary between the individual piece 646, 648 as well as center portions of each piece. The magnetization coil 620 can then be energized with a first current to generate the applied magnetic field 632 that operates to magnetize the exposed regions 654 of the magnet 640 in the first direction, and to induce the eddy currents 680 in the shield bodies 672 that shield the protected regions 652.

Figure 9D:
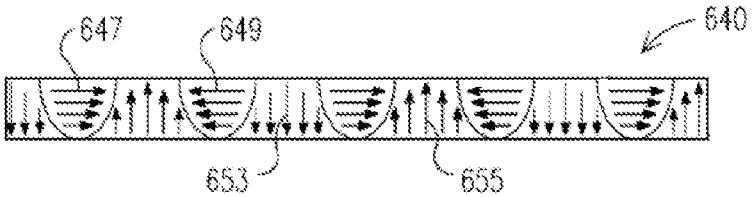

After the first magnetization step is complete, the shield bodies 672 can be moved laterally over the magnet 640 (FIG. 9C) until they cover the previously-exposed and re-magnetized boundary areas 654 and uncover the un-magnetized boundary areas 652, while continuing to cover the center portions of each piece 646, 648. The magnetizing array 622 can then be re-energized with a second current, opposite the first current, to generate the oppositely directed applied magnetic field 633 that magnetizes the now-exposed regions 652 in the second direction, and to induce the eddy currents 681 in the shield bodies 672 that shield the now-protected regions 654 of the magnet 640. As shown in FIG. 9D, the resulting magnet 640 can comprise a multi-pole magnet having a plurality of distinct zones of magnetized material with magnetic domains 647, 649, 653, 655 that are aligned in four different directions, and in the alternating pattern of a Halbach array.

Figure 10:
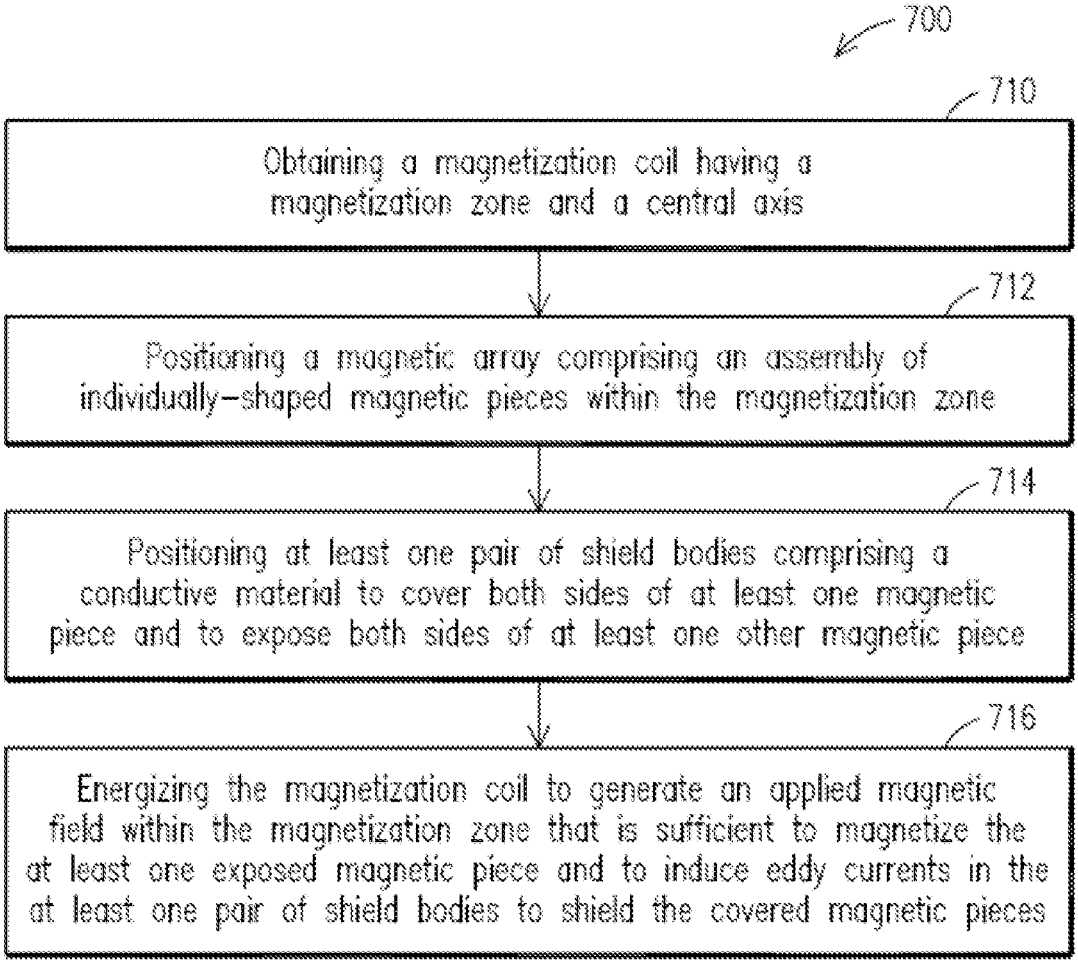
FIG. 10 is a flowchart depicting a method of magnetizing a permanent multi-pole magnet comprising an assembly of individually-shaped magnetic pieces, in accordance with yet another representative embodiment.

FIG. 10 is a flowchart depicting another method 700 of magnetizing a multi-pole magnet. The method 700 includes step 710 for obtaining a magnetization coil having a magnetization zone and a central axis, and step 712 of positioning a magnetic array that includes an assembly of individually shaped magnetic pieces within the magnetization zone. The method 700 also includes step 714 of positioning at least one pair of shield bodies comprising a conductive material to cover both sides of at least one magnetic piece and to expose both sides of at least one other magnetic piece. The method 700 further includes step 716 of energizing the magnetization coil to generate an applied magnetic field within the magnetization zone that is sufficient to magnetize the at least one exposed magnetic piece and to induce eddy currents in the at least one pair of shield bodies to shield the covered magnetic piece.

The invention has been described in terms of preferred embodiments and methodologies considered by the inventors to represent the best mode of carrying out the invention. However, a wide variety of additions, deletions, and modifications might well be made to the illustrated embodiments by skilled artisans without departing from the spirit and scope of the present disclosure. For example, while drawings and descriptions show a single mask applied to each side of the magnet body during magnetization, it is to be appreciated that multiple, different masks may be applied in sequence to alternately expose and cover desired regions of magnetic material to the externally-applied magnetic field. For instance, a first mask may cover a center portion of the magnet body while a second wire-shaped mask may cover a perimeter edge of the magnet body. Similarly, the magnetization coil of may be sized and configured to accommodate multiple mask/magnetic body assemblies at one time, as the system and methodologies described herein are scaled upwards for the mass production of permanent, multi-pole magnets. Those of skill in the art might make these and other revisions without departing from the spirit and scope of the disclosure that is constrained only by the following claims.

What is claimed is:

1. A method for forming a multi-pole magnet using a magnetization coil that defines a magnetization zone having a central axis, the magnetization coil being configured to generate a magnetic field aligned with the central axis, the method comprising:

for a multi-pole magnetic assembly positioned entirely within the magnetization zone, the multi-pole magnetic assembly comprising:

a magnetic substrate having a first surface and a second surface that is parallel to and opposite the first surface, and a magnetic shield arranged to magnetically isolate a corresponding portion of the magnetic substrate, the magnetic shield comprising a first magnetic shield body at the first surface and a second magnetic shield body at the second surface aligned with the first shield body, wherein the first and second shield bodies are each perpendicular to the common axis;

generating the magnetic field by energizing the magnetic coil, wherein the magnetic field induces an eddy current in the first and second shield bodies of sufficient magnitude to create a counter-magnetic field that effectively prevents an alteration of a magnetic property of the magnetically isolated portion of the magnetic substrate.

2. The method of claim 1, wherein using the magnetization coil further comprises energizing the magnetization coil using a plurality of electrical pulses in a sequence that causes the magnetization coil to generate a shifting magnetic field that induces the eddy currents in the shield body.

3. The method of claim 2, wherein each of the electrical pulses has a duration of between about 1 microsecond and about 10 milliseconds.

4. The method of claim 3, wherein the shield bodies cooperate such that opposite sides of at least a first region of the magnet are covered and opposite sides of at least a second region of the magnet are uncovered.

5. The method of claim 4, wherein the magnet takes the form of a single monolithic body.

6. The method of claim 4, wherein the magnet further comprises an assembly of a plurality of monolithic bodies.

7. The method of claim 6, wherein at least two of the plurality of monolithic bodies are magnetized with polarities oriented in different directions prior to generation of the magnetic field in the magnetization zone.

8. The method of claim 1, wherein the magnet is un-magnetized prior to generation of the magnetic field in the magnetization zone.

9. The method of claim 1, wherein the magnet is magnetized with a first polarity prior to generation of the magnetic field in the magnetization zone.

10. The method of claim 9, wherein the magnetic field generated by the magnetization coil is aligned in a second direction in accordance with a second polarity that is substantially opposite the first polarity.

11. A method of forming a plurality of magnetic poles in a magnetic substrate using a magnetization coil that defines a magnetization zone having a central axis, the method comprising:

for a magnetic assembly positioned entirely within the magnetization zone, the magnetic assembly comprising:

a magnetic substrate having a first surface and a second surface that is parallel to and opposite the first surface, and a magnetic shield arranged to magnetically isolate a corresponding portion of the magnetic substrate, the magnetic shield comprising a first magnetic shield body at the first surface and a second magnetic shield body at the second surface aligned with the first shield body, wherein the first and second shield bodies are each perpendicular to the common axis;

shielding a first portion of the magnetic substrate with the magnetic shield formed from electrically conductive material; and applying a shifting magnetic field to the magnetic substrate that magnetizes a second portion of the magnetic substrate so that the second portion of the magnetic substrate includes magnetic poles arranged in a first direction, wherein interaction between the shifting magnetic field and the magnetic shield bodies creates eddy currents in the magnetic shield bodies that prevent the first portion of the magnetic substrate from being magnetized by the shifting magnetic field.

12. The method as recited in claim 11, further comprising:

shifting the shield bodies to cover the second portion of the magnetic substrate; and applying another shifting magnetic field to the magnetic substrate that magnetizes the first portion of the magnetic substrate so that the first portion of the magnetic substrate includes magnetic poles arranged in a second direction different than the first direction.

13. The method as recited in claim 12, wherein the magnetization coil creates magnetic fields in different directions by reversing a flow of current through the magnetization coil.

14. A magnetizing system for magnetizing a magnetic substrate having a first surface and a second surface that is parallel to and opposite the first surface, the magnetizing system comprising:

a magnetic field emitter having a central axis and configured to create a shifting magnetic field within a magnetization zone aligned with the central axis, the magnetic field emitter defining a magnetization zone;

first and second plurality of shield bodies entirely within the magnetization zone formed from electrically conductive material and configured to mask a portion of the magnetic substrate from the shifting magnetic field with the first shield body positioned at the first surface and the second shield positioned at the second surface and aligned with the first shield body, wherein the first and second shield bodies are each perpendicular to the central axis when magnetic substrate is being magnetized; and a power supply configured to provide pulses of current to the magnetic field emitter until an unshielded portion of the magnetic substrate is magnetized by the shifting magnetic field.

15. The magnetizing system as recited in claim 14, wherein the shifting magnetic field is configured to generate eddy currents within the shield bodies.

16. The magnetizing system as recited in claim 15, wherein at least two of the plurality of shield bodies include stepped interior edges that channel an amount of counter flux generated by the eddy currents into a surface area adjacent exterior surfaces of the magnetic substrate.

17. The magnetizing system as recited in claim 14, wherein at least one of the plurality of shield bodies is a different shape or size than at least one other of the plurality of shield bodies.

18. The magnetizing system as recited in claim 14, wherein the magnetic field emitter is a magnetic coil.

19. The magnetizing system as recited in claim 14, wherein the shield bodies are configured to be arranged to substantially prevent a portion of the magnetic substrate positioned between the shield bodies from being affected by the shifting magnetic field.

* * * * *